US011266192B2

(12) United States Patent
Pagano et al.

(10) Patent No.: US 11,266,192 B2
(45) Date of Patent: Mar. 8, 2022

(54) MULTIPURPOSE, CROSSBODY STRAP WITH UNIVERSAL IN INTERLOCKING RINGS

(71) Applicants: Scott Pagano, Virginia Beach, VA (US); Kelly J. Hollowell, Virginia Beach, VA (US)

(72) Inventors: Scott Pagano, Virginia Beach, VA (US); Kelly J. Hollowell, Virginia Beach, VA (US)

( * ) Notice: Subject to any disclaimer, the term of this patent is extended or adjusted under 35 U.S.C. 154(b) by 0 days.

(21) Appl. No.: 17/133,572

(22) Filed: Dec. 23, 2020

(65) Prior Publication Data

US 2022/0015484 A1 Jan. 20, 2022

Related U.S. Application Data

(63) Continuation-in-part of application No. 16/930,089, filed on Jul. 15, 2020, now Pat. No. 10,897,943.

(51) Int. Cl.

| | |
|---|---|
| ***A41F 9/02*** | (2006.01) |
| ***A44B 11/26*** | (2006.01) |
| ***A44B 11/25*** | (2006.01) |
| ***A45C 13/30*** | (2006.01) |
| ***A45F 3/14*** | (2006.01) |

(52) U.S. Cl.

CPC ..... *A41F 9/025* (2013.01); *A44B 11/263* (2013.01); *A44B 11/2592* (2013.01); *A45C 13/30* (2013.01); *A45F 3/14* (2013.01); *A45F 2003/142* (2013.01)

(58) Field of Classification Search

CPC ..... A44B 11/25; A44B 11/26; A44B 11/263; A44B 11/28; A44B 11/2592; A45C 13/30; A45F 3/14; A45F 2003/142

USPC ..... 224/257, 258, 578

See application file for complete search history.

(56) References Cited

U.S. PATENT DOCUMENTS

| | | | |
|---|---|---|---|
| 769,037 | A | 8/1904 | Wechsler |
| 1,772,393 | A | 8/1930 | Guttman |
| 2,025,886 | A | 12/1935 | Nordstrom |
| 2,262,269 | A | 11/1941 | Cooper |
| 2,480,874 | A | 9/1949 | Neumann |
| 2,809,408 | A | 10/1957 | Goldstein |
| 3,931,917 | A | 1/1976 | Zellmer |
| D278,386 | S | 4/1985 | Share |

(Continued)

FOREIGN PATENT DOCUMENTS

| | | |
|---|---|---|
| CA | 2 790 127 A1 | 11/2012 |
| CN | 202504515 U | 10/2012 |

(Continued)

*Primary Examiner* — Justin M Larson

(74) *Attorney, Agent, or Firm* — Hollowell Patent Group; Kelly Hollowell

(57) ABSTRACT

An ambidextrous, adjustable cross-body strap comprising a plurality of variably sized pockets, a buckle and universal interlocking keyring system for added user security. The cross-body strap can be worn under or over a shirt or jacket. In one embodiment, it is water resistant or waterproof. In one embodiment, the cross-body strap has interchangeable clasps and hooks that are stored in one of the plurality of pockets built into the strap. The interchangeable clasps hook and carabiners can be used separately or in combination with the universal interlocking rings to self-attach or alternatively attach to any messenger bag, gym bag tactical clips, such as a keyring holder, straps with snaps or briefcase.

13 Claims, 16 Drawing Sheets

(56) References Cited

U.S. PATENT DOCUMENTS

| | | | | |
|---|---|---|---|---|
| D279,424 | S | 7/1985 | Leiserson | |
| 4,525,879 | A | 7/1985 | Kalomeris | |
| 4,747,527 | A | 5/1988 | Trumpower, II | |
| 4,923,105 | A | 5/1990 | Snyder | |
| 5,950,893 | A | 9/1999 | Heggeland | |
| 6,662,986 | B2 | 12/2003 | Lehtonen | |
| 6,834,621 | B1 | 12/2004 | O'Neill | |
| D505,787 | S | 6/2005 | Vaughn | |
| 7,059,371 | B2 | 6/2006 | Renn | |
| 7,278,684 | B2 | 10/2007 | Boyle | |
| 7,699,197 | B2 | 4/2010 | Panosian et al. | |
| 8,225,973 | B1 | 7/2012 | Beilinson | |
| 9,044,080 | B2 | 6/2015 | Ashenafi | |
| 9,526,301 | B1 | 12/2016 | Sloan | |
| 9,560,898 | B2 | 2/2017 | Hortnagl | |
| 9,854,889 | B2 | 1/2018 | Amago | |
| 10,340,636 | B1 | 7/2019 | Twenge | |
| 10,897,943 | B1 * | 1/2021 | Pagano | A45C 13/26 |
| 2007/0084895 | A1 | 4/2007 | Bowen | |
| 2009/0194571 | A1 | 8/2009 | Evans | |
| 2010/0025447 | A1 | 2/2010 | Smart | |
| 2015/0313337 | A1 | 11/2015 | Swartzel | |
| 2016/0037876 | A1 | 2/2016 | Perkins et al. | |
| 2016/0206061 | A1 | 7/2016 | Ford | |
| 2016/0286941 | A1 | 10/2016 | Wheeler-Christ | |
| 2019/0014888 | A1 | 1/2019 | Duncan | |
| 2019/0191863 | A1 | 6/2019 | Carter | |
| 2020/0000198 | A1 | 1/2020 | Schroeder | |

FOREIGN PATENT DOCUMENTS

| | | | |
|---|---|---|---|
| CN | 205358486 | U | 7/2016 |
| DE | 20 2015 103 111 | U1 | 7/2015 |
| WO | 2013/014425 | A1 | 1/2013 |

* cited by examiner

MULTIPURPOSE, CROSSBODY STRAP WITH UNIVERSAL IN INTERLOCKING RINGS

PRIORITY INFORMATION

This application is a Continuation-in-part (CIP) of U.S. patent application Ser. No. 16/930,089 filed Jul. 15, 2020.

FIELD OF THE INVENTION

The present, invention combines a men's wallet with the capacity of a fanny pack, the fashion of a chest sling and the multifunctional utility of a duty belt. It is a fashionable ambidextrous adjustable cross-body strap with a buckle, buckle slide cover, a universal keyring lock system and a plurality of variably sized pockets located on both sides of the strap. It is perfect for outdoorsman but also fashionable and discreet for wearing under business attire. It is made of sturdy but sleek water resistant or waterproof material and the plurality of variably sized pockets are suitable for money, credit cards, pocketknife, cell phone, keys, notes, ear pods, blue tooth technology, phone charger etc. The buckle adapted ends of the cross-body strap co-terminate with a universal keyring system that can be linked together for added security alternatively, the universal keyring system can be linked to a traditional shoulder bag or suitcase when larger storage is required. The slidable buckle cover also provides a third layer of security as protection against accidental release of the buckle and strap.

BACKGROUND OF THE INVENTION

A wallet is a small, flat case used to carry small personal items such as money, credit cards, and identification. Wallets are often pocket-sized, discreet and generally made of leather or fabric. Wallets may also have features such as money clips; a coin purse; a chain fastener, strap or a zipper. In addition to their practical function, wallets may be used as a fashion accessory.

There are many types of wallets. For example, a Breast wallet is used for folded money and credit cards and carried in the breast pocket of a man's jacket. A Money clip wallet is similar to a front pocket wallet in terms of size. However, the money is usually held in by a clip secured by a strong magnet. A Long wallet is a larger wallet that includes a coin purse and is usually worn with jeans, fastened by a chain or leather strap. An ID case/neck pouch is often a thin nylon or leather case with plastic see-through compartments designed to hold an ID card, credit card and/or a few bills. A Shoe wallet is a small pouch attached to a shoe designed primarily for people exercising. A Tactical wallet is a wallet and Swiss army knife rolled into one, complete with a small knife, bottle opener_ or other gadgetry. Money belts, a larger version of the traditional wallet, are belts with secret compartments often worn by tourists to protect valuables from thieves and/or pickpockets, while the man purse is a cross-body that gave rise to the fanny pack which is a small fabric pouch worn around the waist.

Although the fanny pack is as emasculating as the man purse; their practicality makes them very popular. Mobile devices (and USB charging cables and backup batteries), keys, money, credit cards, IDs, bottles of water, snacks, tissue paper, first aid, isopropyl alcohol, and glasses are among some of the most common items stored in the bag. More recently the fanny pack has been replaced by the slightly edgier chest sling. Sling bags are a fashion statement, but also a convenient way to carry the essentials while traveling about in an uber tech world. Think of them as the middle ground between a backpack and your pockets.

On the other end of fashion and extremely masculine are the duty belts (sometimes referred to as a gun belt, "duty rig" and/or kit belt). These are belts, typically worn by law enforcement, military and handymen to carry equipment easily in a series of pouches attached to the belt, in a readily accessible manner, while leaving the hands free to interact. This belt can carry any number of useful items, ranging from keys, money, batteries, gloves, pens, pencils, keys, multi-tool, window punch handcuffs to guns. Duty belts wrap commonly around the user's waist and often fasten with a buckle at the front. Belt suspenders are often used with a duty belt to move a portion of the weight of the belt onto the shoulders, reducing the weight imposed on the lower back.

None of these traditional devices provides a practical and fashionable solution for the modern man in and ever-increasing techno-gadget world. What is needed is the discretion of a traditional man's wallet combined with the capacity of a fanny pack, fashion of sling bag and masculinity of an adjustable utility belt that can be securely worn either under or over men's clothes and provide maximum functionality and fashion.

SUMMARY OF THE INVENTION

The present invention combines the features of a men's wallet with the capacity of a fanny pack with a multifunctional utility or duty belt in a fashionable ambidextrous adjustable cross-body pocketed strap. It can be worn discreetly under a shirt or jacket but is also fashionable outerwear; with or without a shirt. It is perfect for outdoorsman but also a gentlemen's replacement for a traditional wallet, fanny pack or chest sling. It has a sleek design with a plurality of variably sized pockets for cell phone, keys, notes, ear pods, blue tooth technology, phone charger etc. The ends of the cross-body strap attach to each other with a unique buckle and universal interlocking ring. In addition, the universal interlocking ring system can self-attach or can clip onto a traditional shoulder bag, backpack or carryon luggage. Replacing a traditional three-way buckle system, the current invention includes a quick release buckle, a slidable buckle cover and a universal interlocking keyring system to decrease accidental release of the strap by anyone but its wearer.

DETAILED DESCRIPTION OF THE PREFERRED EMBODIMENTS

It is to be understood that the specific devices and processes illustrated in the attached drawings and described in the following specification are exemplary embodiments of the inventive concepts defined in the appended claims. Hence, specific dimensions and other physical characteristics relating to the embodiments disclosed herein are not to be considered as limiting, unless the claims expressly state otherwise.

Figure 1A:
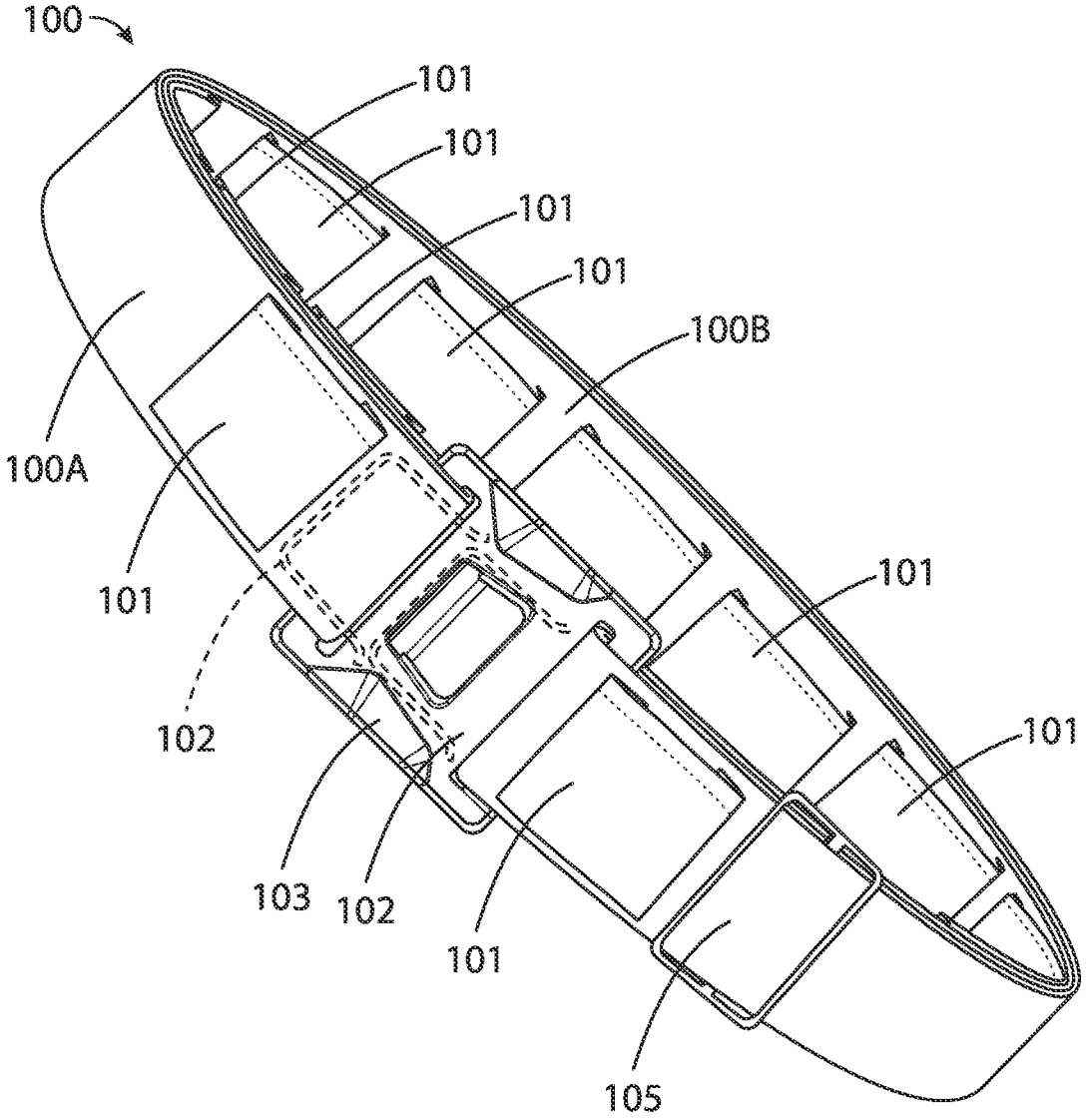
FIG. 1A is a perspective view of the cross-body strap with buckle slide cover.
Figure 1B:
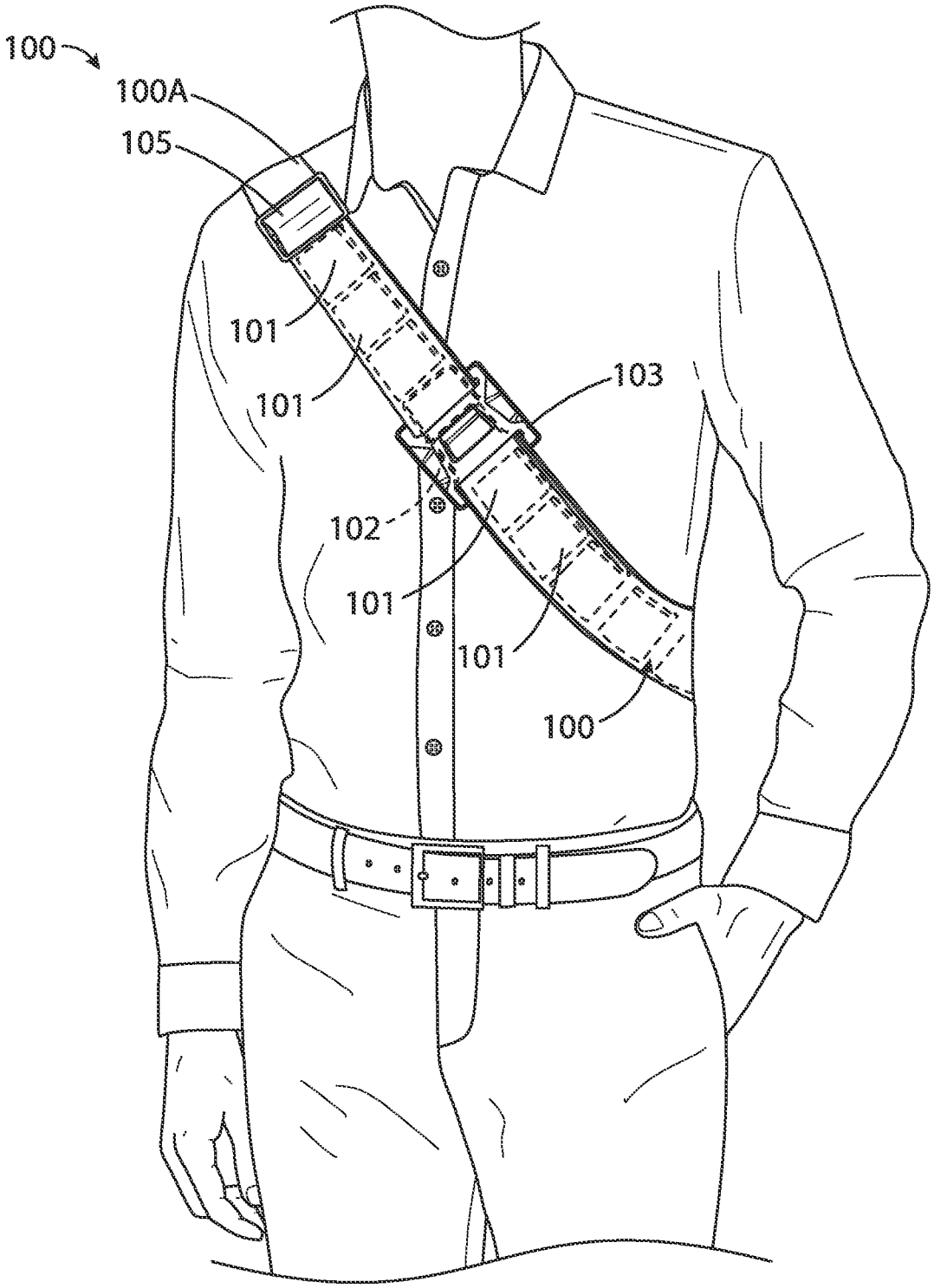
FIG. 1B is a perspective view of the cross-body strap as worn by a user.

FIG. 1A provides a perspective view respectively of the cross-body strap 100 having an adjustable length terminating in a closed buckle 102, a slidable buckle cover 103 covering the buckle 102, a plurality of pockets 101 and a strap length adjuster 105 such as a tri-glide slide making the cross-body strap 100 able to be adjusted to fit the user. FIG. 1B provides a view of the cross-body strap with buckle slide cover as worn by a user.

Figure 2:
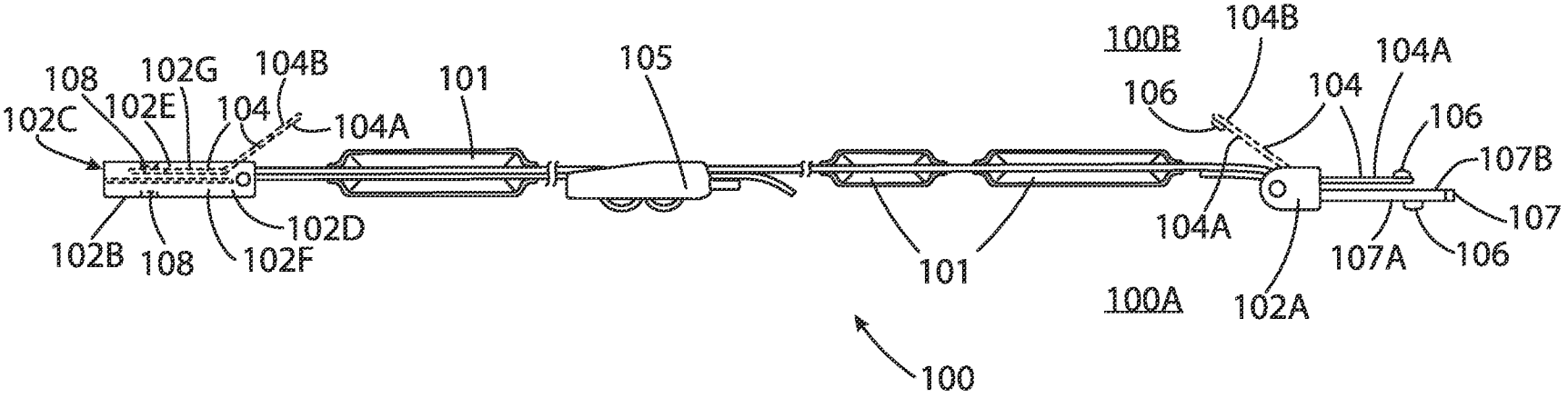
FIG. 2 is a side perspective view of the cross-body strap.

FIG. 2 provides a side perspective view of the cross-body strap 100 in the open position. In this illustration, the buckle 102 is shown detached in two interlocking pans: a male end 102A and a female end 102B. The male end 102A comprises a first movable ring 104 with a bottom surface 104A and a top surface 104B that is mechanically connected to a prong 107 comprising a bottom surface 107A and a top surface 107B; and a first compressible button 106 located on the prong bottom surface 107A and a second compressible button 106 located on the ring bottom surface 104A.

Also shown in FIG. 2, the female end 102B comprises a second movable ring 104 with a bottom surface 104A and a top surface 104B that is mechanically connected to a horizontally bifurcated slot 102C comprising a top outer surface 102D, a bottom outer surface 102E, a top cavity 102F and a bottom cavity 102G; and a first locking button hole 108 located on the top outer surface 102D and a second locking button hole 108 located on the bottom outer surface 102E. FIG. 2 also illustrates a strap adjuster 105, commonly known in the art, to adjust the length of the strap 100 to the user's preference and body size.

Figure 3A:
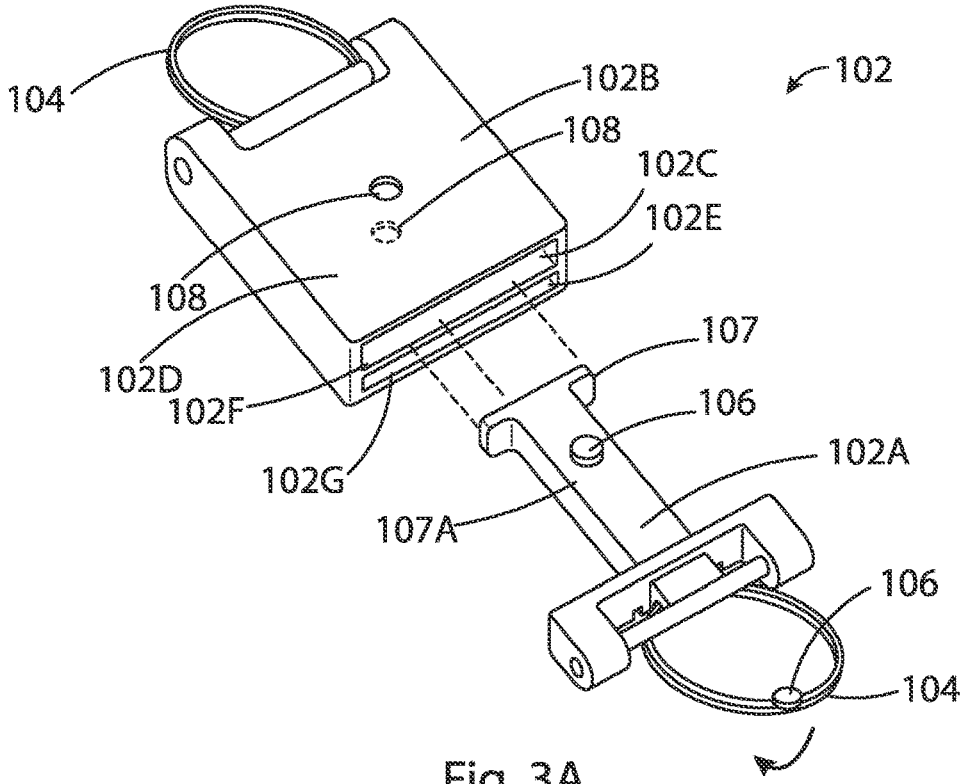
FIG. 3A-3C is a perspective view of the cross-body strap open and closed buckle.
Figure 3B:
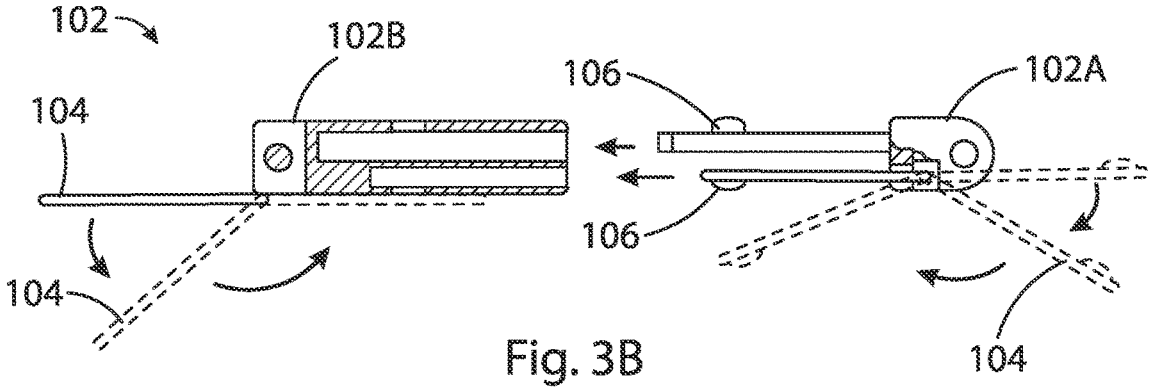
Figure 3C:
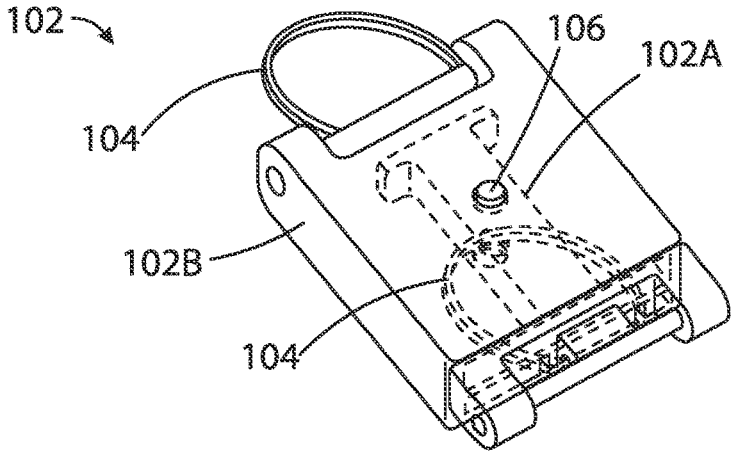

FIGS. 3A-3C show a closed embodiment of the cross-body strap 100 in which prong 107 is inserted into the top cavity 102F of the bifurcated slot 102C and the first compressible button 106 located on the prong bottom surface 107A is inserted into the first locking button hole 108 located on the top outer surface 102D of the bifurcated slot 102C; and the first movable ring 104 operably connected to the prong 107 is inserted into the bottom cavity 102G of the bifurcated slot 102C and the second compressible button 106 into the second locking button hole 108 located on the bottom outer surface 102E of the bifurcated slot 102C. In this configuration, the inserted prong 107 and the inserted first movable ring 104 provide a dual locking system for buckle 102 and overall strap 100. The compressible button 106 provide a quick release mechanism. The buckle 102 is unlocked or released by pressing the first and second compressible buttons 106.

Traditionally, money and/or utility belts have been fastened using a metal buckle; however, this is changing for a number of reasons. Now plastic buckles are more common, and many incorporate a three-way buckle system for added security. As an example, some systems require the wearer to depress a third release catch before the buckles may be separated; this is to decrease the chance of the belt being released by anyone but its wearer. This traditional three-way buckle system is replaced by the present invention with a unique three-way locking buckle and a universal interlocking ring system that can self-attach or attach to a larger luggage unit.

In one embodiment, the slidable buckle cover 103 is made of incompressible material such as but not limited to a hard plastic or thin metal. The slidable buckle cover 103 therefore serves as an external safety mechanism that prevents accidental access or release of the first, and second compressible buttons 106. In one embodiment, the buckle slide cover may be embossed with initials or insignia for an individual, military unit or team. In another embodiment, it may be embossed or imprinted with a logo or other symbol to connote a particular brand or convey a message.

Figure 4B:
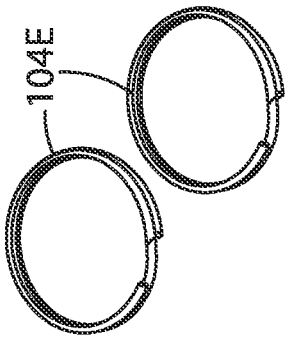
FIG. 4A-4C is a perspective view of the cross-body strap interlocking rings.
Figure 4A:
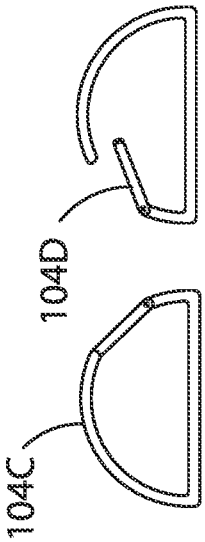
Figure 4C:
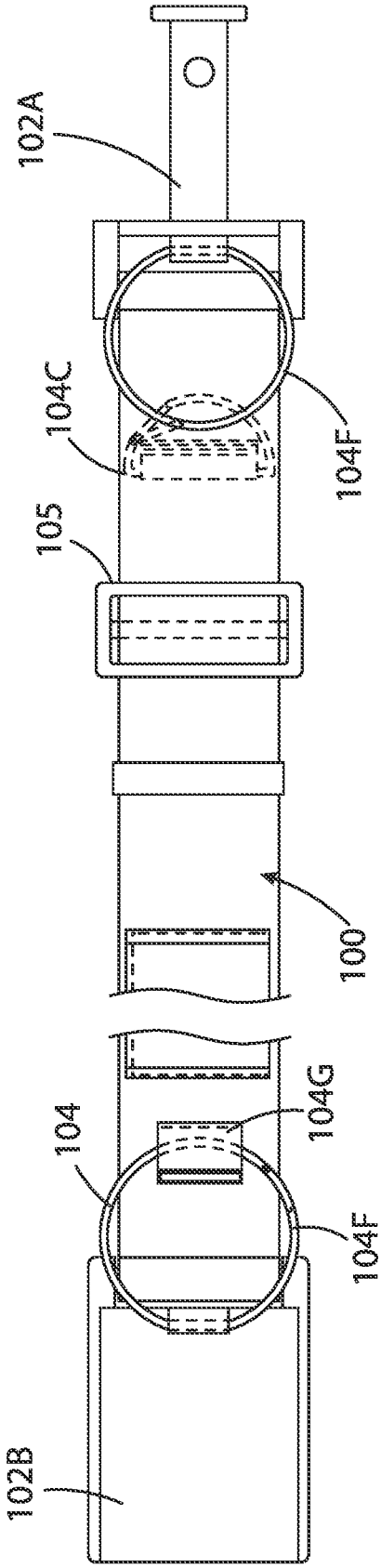

FIGS. 4A and 4B illustrate exemplary embodiments for the first and second movable rings. FIG. 4A illustrates a D-ring 104C with a collapsible latch 104D. FIG. 4B illustrates a keyring configuration referred to hereafter as "keyrings". FIG. 4C illustrated a circular ring 104E with a collapsible latch 104D as shown with the D-ring 104C. When the movable rings are not in use, they may be held in place by a Velcro strap 104G located on the bottom or back surface 100B of the strap.

In another embodiment and as commonly known the art, the Velcro strap 104G can be substituted with any similar mechanism such as but not limited to a strap with a snap or button (not shown). The rings might also be held in place by a sleeve or pocket located on the bottom or back surface 100B of the strap 100 (not shown). In one embodiment, the D-ring 1040 can be sewn into the bottom or back surface 100B of the strap 100 and the collapsible latch 104D can be opened to interconnect the rings and hold the movable keyrings to the back surface 100B of the strap 100. Securing the movable rings to the bottom or back surface 100B of the strap 100 hides them from view when not in use to create a clean look on the top or front surface 100A of the strap 100.

Figure 5A:
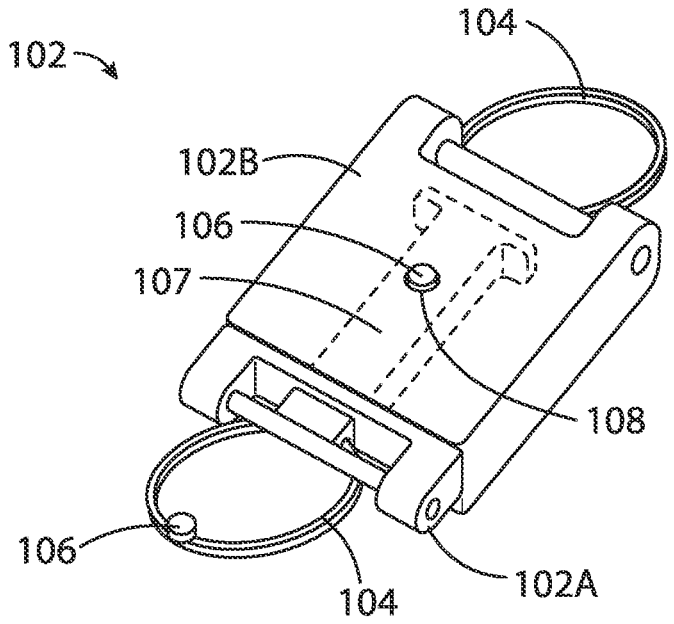
FIG. 5A-5B is perspective view of an alternate locking embodiment.
Figure 5B:
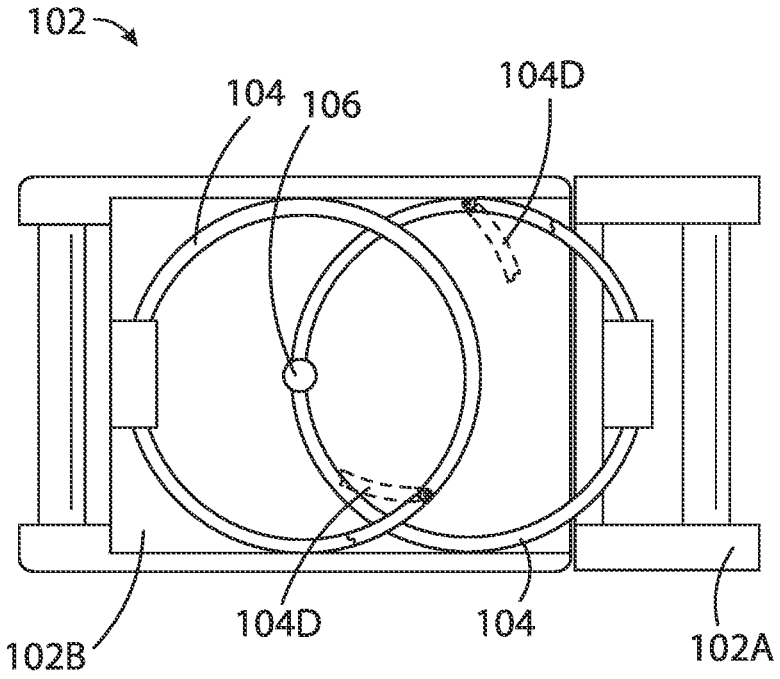

FIG. 5A shows a closed embodiment of the cross-body strap 100 in which prong 107 is inserted into the top cavity 102F of the bifurcated slot 102C and the first compressible button 106 located on the prong bottom surface 107A is inserted into the first locking button hole 108 located on the top outer surface 102D of the bifurcated slot 102C. FIG. 5B shows a closed embodiment of the cross-body strap 100 in which the first movable ring 104 mechanically connected to the prong 107 is interlinked with the second movable ring 104 mechanically connected to the horizontally bifurcated slot 102C. In this configuration, the inserted prong 107 and the interlinked first and second ring 104 provide an added measure of security in locking the strap 100 to the user's body. The buckle 102 is unlocked or released by pressing the first compressible button 106 and disconnecting the movable rings 104.

Figure 6:
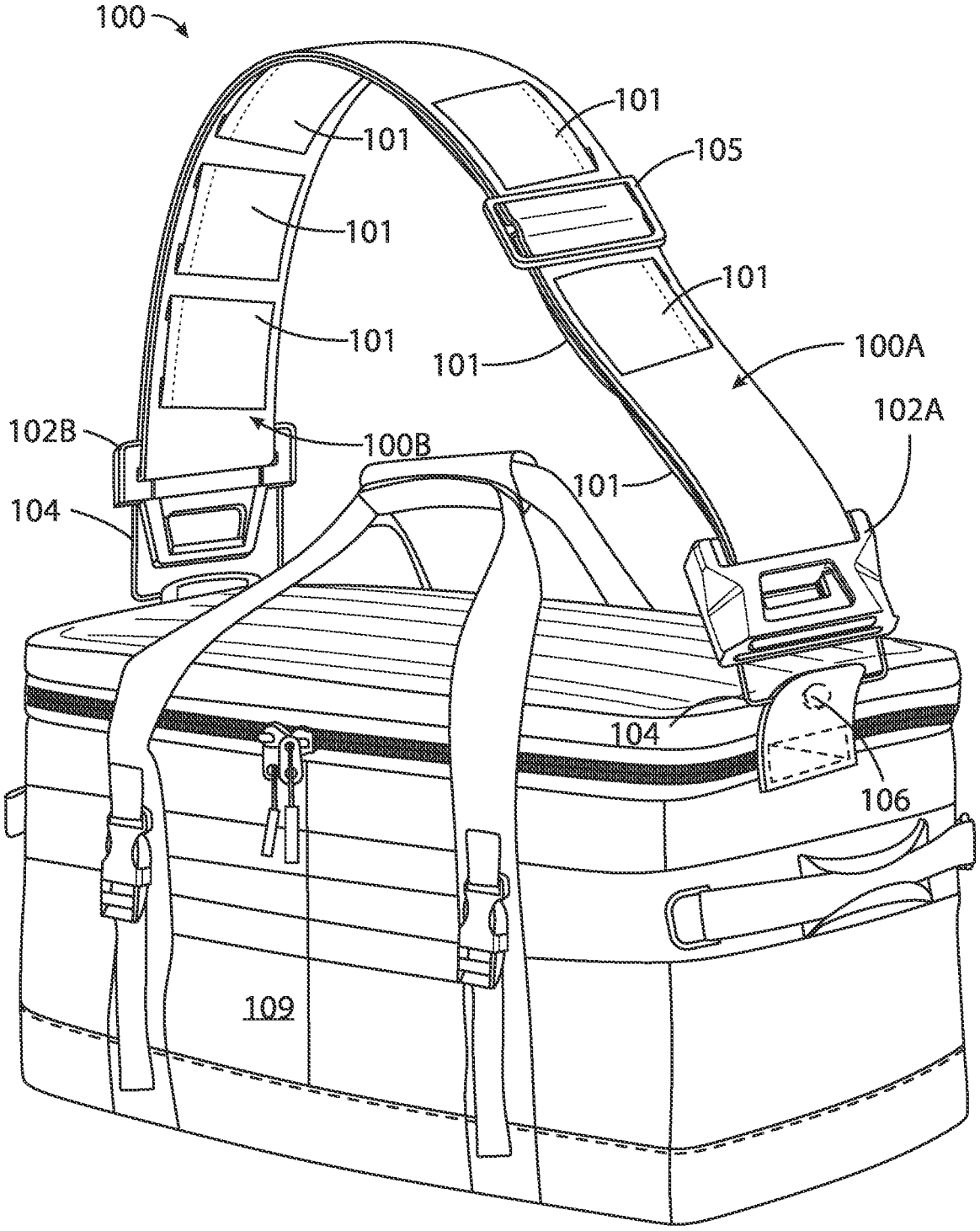
FIG. 6 is a perspective view of the cross-body strap attached to suitcase.

In one embodiment, the first movable ring 104 and second movable ring 104 operate as a universal interlocking ring system as illustrated in FIG. 6. More specifically, rings 104 can attach to each other or be linked to a traditional shoulder bag, fanny pack or suitcase when larger storage capacity is required. Depending on the configuration of the larger bag or suitcase, the strap 100 might also be engaged as describe in FIGS. 3-5 under a larger suitcase flap 109 such as the one shown FIG. 6. In this embodiment, a user may carry a bag onto an airplane, for example, and quickly release the larger bag for storage into an overhead compartment and then just as quickly buckle the strap 100 back to the user. This keeps all necessary personal items such as tickets, money, phone or medicine at the user's fingertips; no more rummaging through a suitcase for the items the user wants close at hand.

Figure 7A:
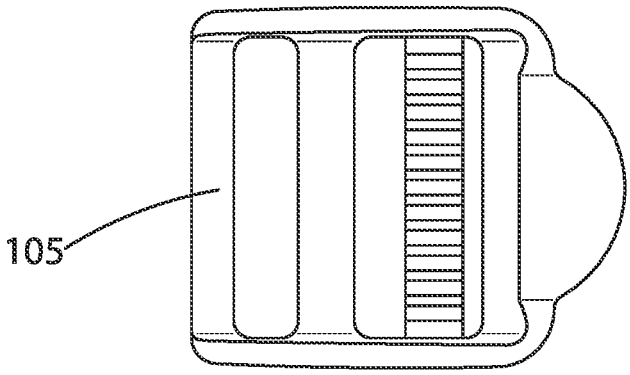
FIG. 7A-7B is an enlarged perspective view of the top and bottom of the strap adjuster.
Figure 7B:
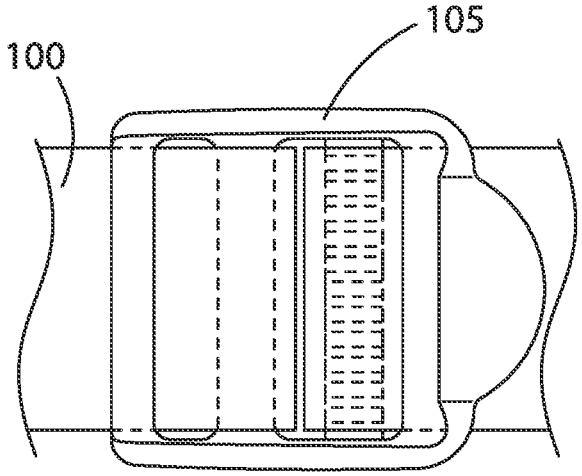

FIGS. 7A and 7B illustrate a top and bottom view respectively of a commonly known and used tri-bar strap adjuster 105. Historically belts, straps slings and backpacks have and use tri-glide slides, making them able to be adjusted to fit. In one embodiment, the dimensions of the strap may range from 48 to 86 inches in length and from 1.5 to 5 inches in width. In one embodiment, the width is 2.25 inches. In one embodiment, the length is 66 inches, and the width is 2.5 inches.

FIGS. 8-13 provide an alternate embodiment for the buckle 802 and the universal interlocking ring system that can be used with and attached to the cross-body strap 100. All other features of the cross-body strap previously described apply when using the alternate embodiment for the buckle 802.

FIGS. 8-13 also provide an alternate embodiment for the universal interlocking ring system buckle 802 and the universal ring system that can be used with and attached to the cross-body strap 100. In addition, as previously described the first movable ring 104 and second movable ring 104 operate as a universal interlocking ring system as illustrated in FIG. 6.

Figure 8A:
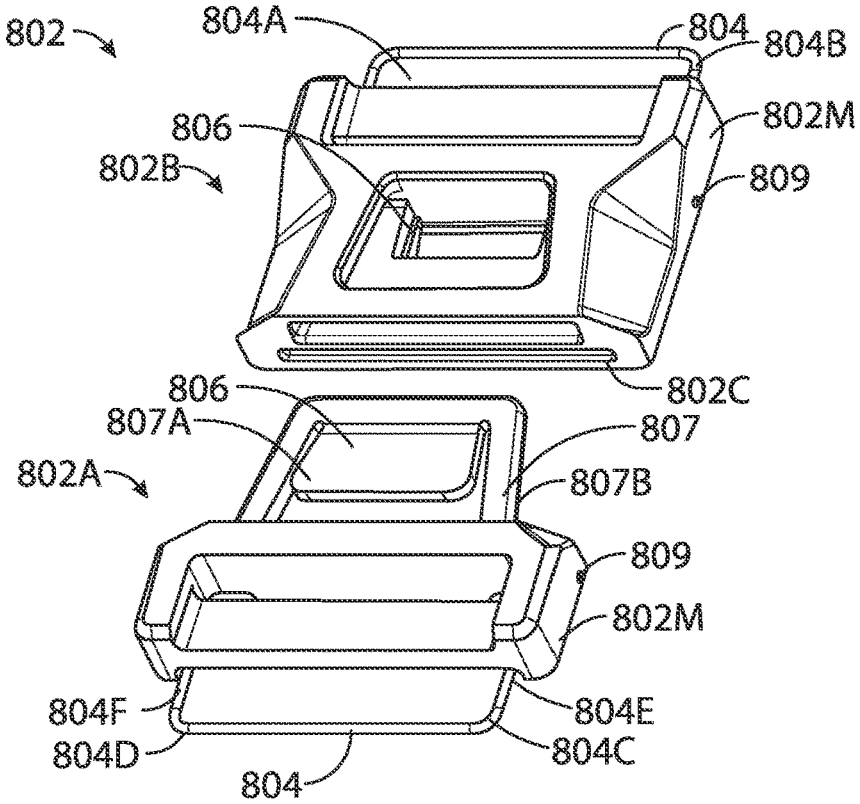
FIG. 8A is a top perspective view of the disengaged female end and male end of the buckle with the female and male flexible arms in position to be attached to the strap.
Figure 8B:
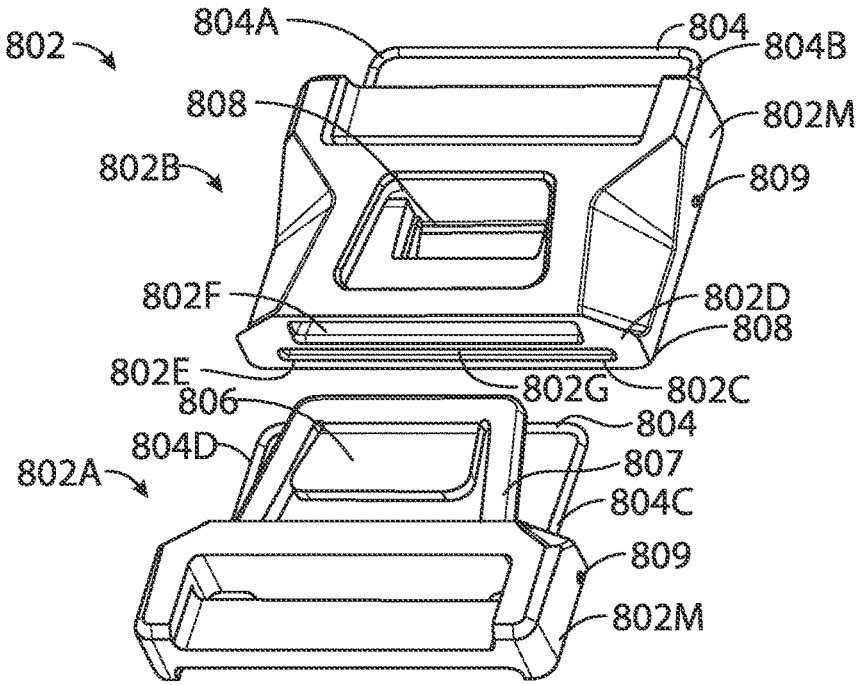
FIG. 8B is a top a perspective view of the disengaged female end and, male end of the buckle with the female arm in position to be attached to the strap and the and male flexible arm in position to engage the bifurcated slot of the female end of the buckle.
Figure 8C:
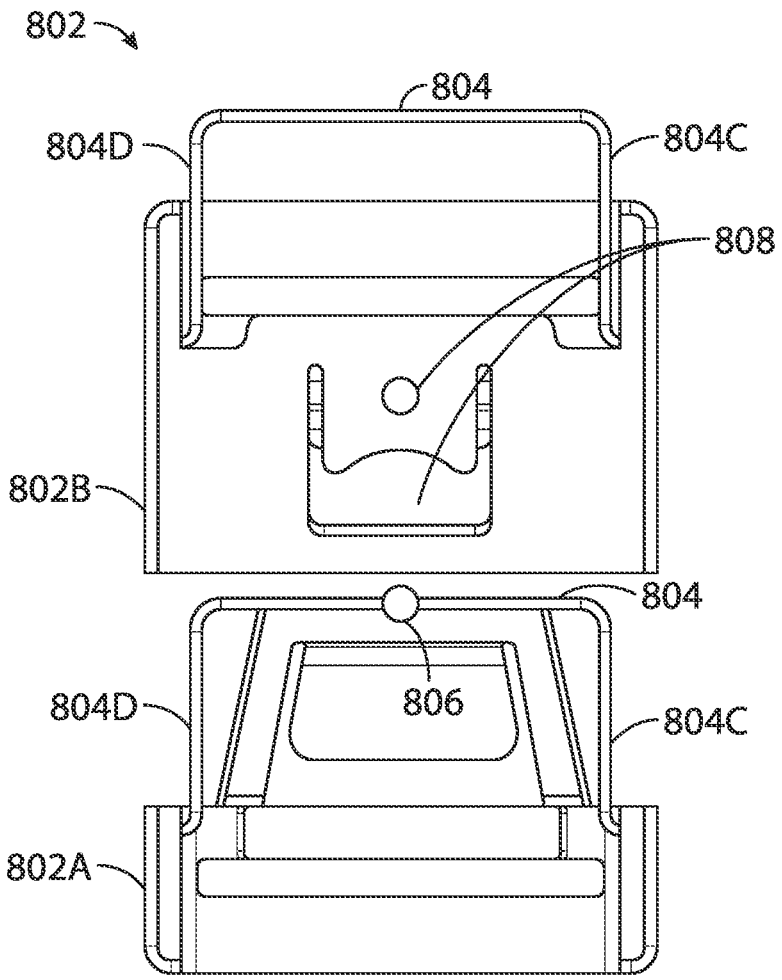
FIG. 8C is a bottom perspective view in the form of the disengaged female end and male end of the buckle with the female arm in position to be attached to the strap and the and male flexible arm in position to engage the bifurcated slot of the female end of the buckle.

FIG. 8 provides a top perspective view of the disengaged female end and male end of the buckle with the female and male flexible arms in position to be attached to the strap (not shown). In this illustration, the buckle 802 is shown detached in two interlocking parts: a male end 802A and a female end 802B. The male end 802A comprises a prong 807 and a first movable two-prong flexible arm 804 with a bottom surface 804A and a top surface 804B, a right prong 804C and left prong 804D wherein right prong 804C terminates in a compressible flat surface 804E and left prong 804D terminates in a compressible flat surface 804F. The flat compressible flat surfaces 804E and 804F insert into holes 809 located on each side lateral side 802M of male end 802A of buckle 802 thereby mechanically connecting to the male end 802A of the buckle 802. The prong 807 comprises a bottom surface 807A and a top surface 807B; and a first compressible button 806 located on the prong bottom surface 807A and a second compressible button 806 located on the first movable two-prong flexible arm bottom surface 104A.

Also shown in FIG. 8, the female end 802B of the buckle 802 comprises a second movable two-prong flexible arm 804 with a bottom surface 804A and a top surface 804B that is mechanically connected to the female end 802B of the buckle 802, a horizontally bifurcated slot 802C comprising a top outer surface 802D, a bottom outer surface 802E, a top cavity 802F and a bottom cavity 802G; and a first locking buttonhole 808 located on the top outer surface 802D and a second locking button hole 808 located on the bottom outer surface 802E.

Both flexible arms 804 are made of material that is compressible so that each arm can be fully detached from the retaining holes 809 that lock the arms 804 into each the male end 802A and female end 802B of the buckle. This makes the flexible arms 804 removable. In one embodiment the flexible arms are stored in one of the plurality of pockets 101. In another embodiment, either of the flexible arms can be detached and interconnected with the other flexible arm, then reattached to the buckle 802. In another embodiment, both of the flexible arms can be detached connected to a bag as illustrated in FIG. 6 then reattached to the buckle 802.

Figure 9A:
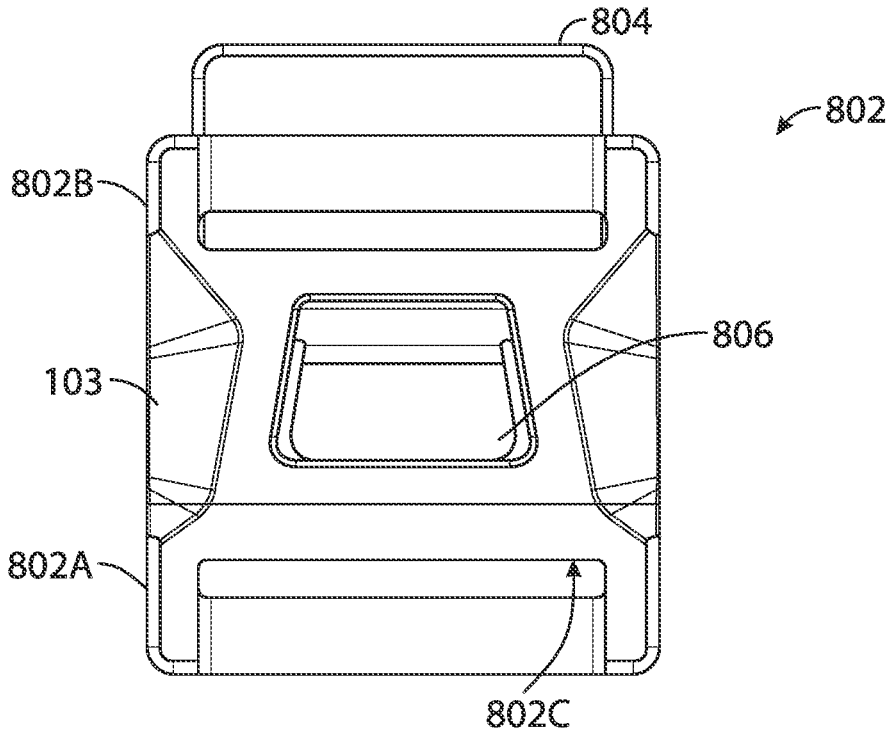
FIG. 9A is a top view of the female end and male end of the buckle engaged with the female flexible arm in position to attach to the strap (not shown) and the male flexible arm inserted into bottom of female bifurcated slot (not visible).
Figure 9B:
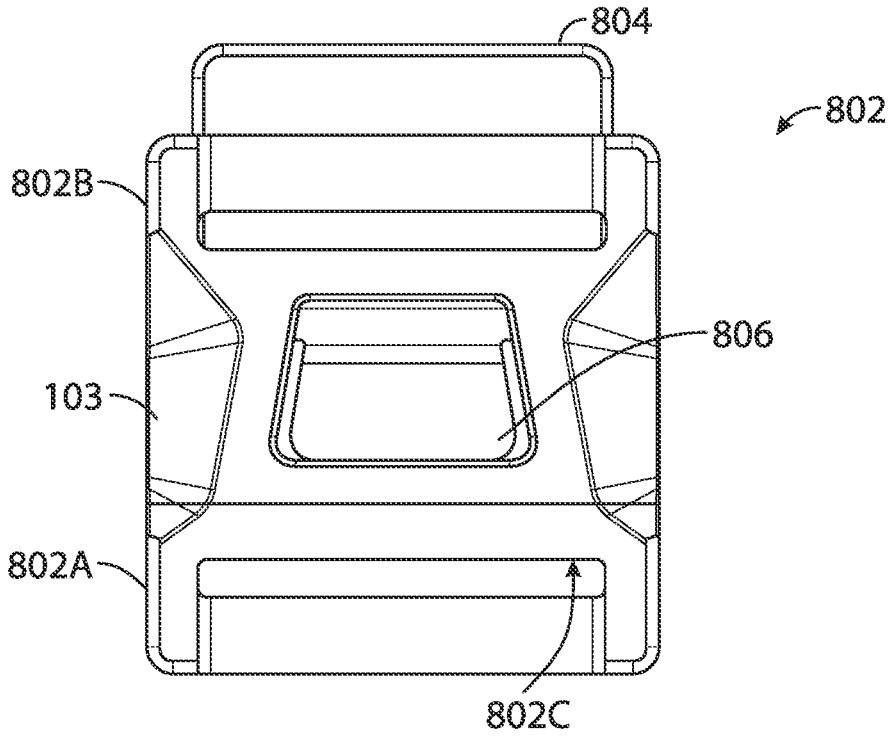
FIG. 9B is also a top view of the female end and male end of the buckle engaged with the female flexible arm in position to attach to the strap (not shown) and the male flexible arm inserted into bottom of female bifurcated slot (not visible).

FIGS. 9A-9C show a closed embodiment of the buckle 80 for the cross-body strap 100 (not shown) in which prong 807 is inserted into the top cavity 802F of the bifurcated slot 802C and the first compressible button 806 located on the prong bottom surface 807A is inserted into the locking button hole 808 located on the top outer surface 802D of the bifurcated slot 802C; and the first movable two-prong flexible arm 804 operably connected to the prong 807 is inserted into the bottom cavity 802G of the bifurcated slot 802C and the second compressible button 806 into the second locking button hole 808 located on the bottom outer surface 802E of the bifurcated slot 802C (not visible). In this configuration, the inserted prong 807 and the inserted first movable two-prong flexible arm 804 provide a dual locking system for buckle 802 and overall strap 100. The compressible buttons 806 provide a quick release mechanism. The buckle 802 is unlocked or released by pressing the first and second compressible buttons 806.

In this buckle embodiment 802, the slidable buckle cover 103 is made of incompressible material such as but not limited to a hard plastic or thin metal. The slidable buckle cover 103 therefore serves as an external safety mechanism that prevents accidental access or release of the first and second compressible buttons 806. In one embodiment, the buckle slide cover may be embossed with initials or insignia for an individual, military unit or team. In another embodiment, it may be embossed or imprinted with a logo or other symbol to connote a particular brand or convey a message.

Figure 10A:
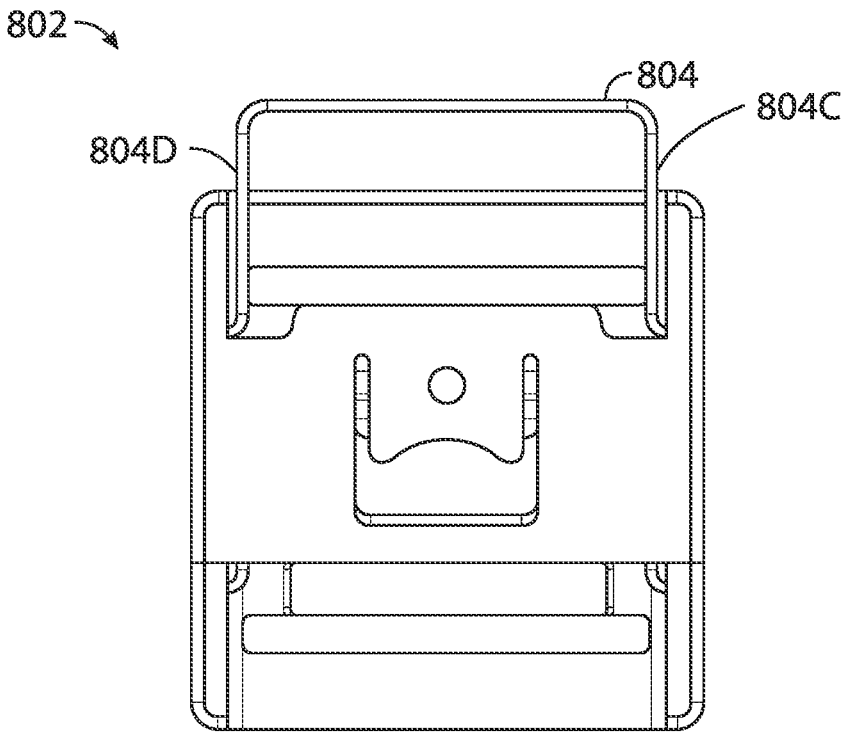
FIG. 10A is a bottom view of the female end and male end of the buckle engaged with the female flexible arm in position to attach to the strap (not shown) and the male flexible arm inserted into bottom of female bifurcated slot (not visible).

FIG. 10A is a bottom view of the female end 802B and male end 802A of the buckle 802 engaged with the second movable two-prong flexible arm 804 in position to attach to the strap (not shown) and the first movable two-prong flexible arm 804 inserted into bottom of female bifurcated slot (not visible).

Figure 10B:
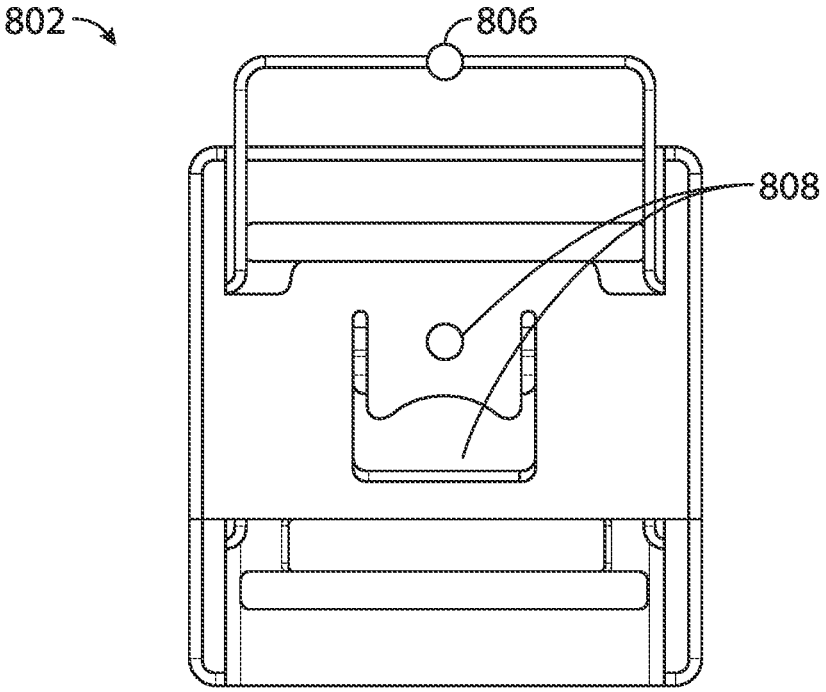
FIG. 10B is also a bottom view of the female end and male end of the buckle engaged with the female flexible arm in position to attach to the strap (not shown) and the male flexible arm inserted into bottom of female bifurcated slot (not visible)

FIG. 10B is also a bottom view of the female end 802B and male end 802A of the buckle 802 engaged with the second movable two-prong flexible arm 804 in position to attach to the strap (not shown) and the first movable two-prong flexible arm 804 inserted into bottom of female bifurcated slot (not visible). FIG. 10B also shows the second movable two-prong flexible arm 804 in position to attach to the strap (not shown) and mechanically connected to the male, end 802A of the buckle 802 with the directional movement of the flexible arm 804 shown with dashed lines indicating the position of the second movable two-prong flexible arm 804 in a contracted or collapsed position required to disengage the arm 804 from the buckle end 802A or 802B. The arms 804 work identically with the male end 802A and female end 802B of the buckle 802. Both flexible arms 804 are made of material that is compressible so that the arm can be fully detached from and reinserted into the retaining holes 809 that lock the arms 804 into each the male end 802A and female end 802B of the buckle.

Figure 10C:
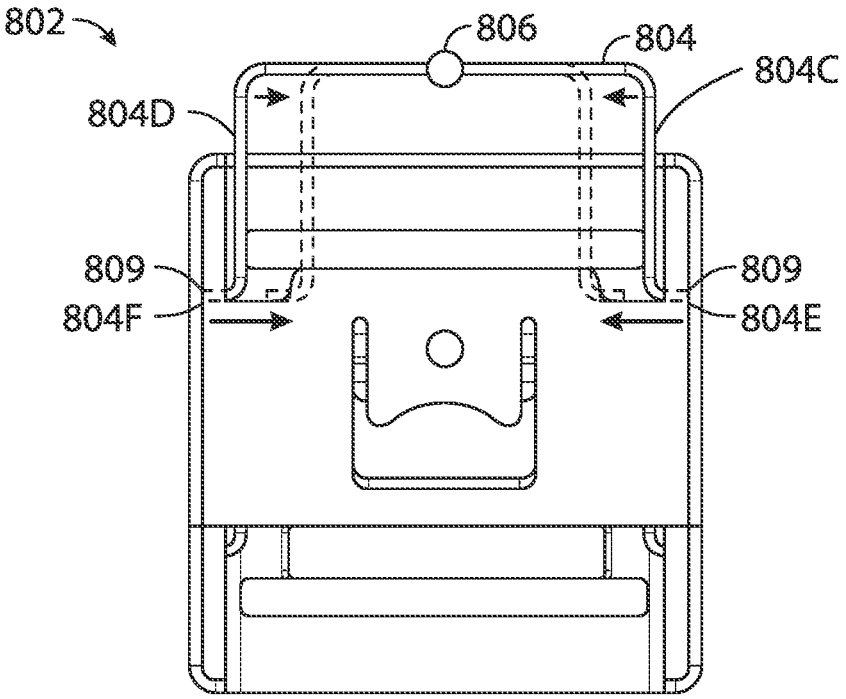
FIG. 10C is an exploded view of the male end flexible arm in an engaged position in the buckle with the directional movement of the male end flexible arm shown with dashed lines indicating the position of the male end flexible arm in the contracted or collapsed position.

FIG. 10C is an exploded view of the male end flexible arm in an engaged position in the buckle with the directional movement of the male end flexible arm shown with dashed lines indicating the position of the male end flexible arm in the contracted or collapsed position.

Figure 11A:
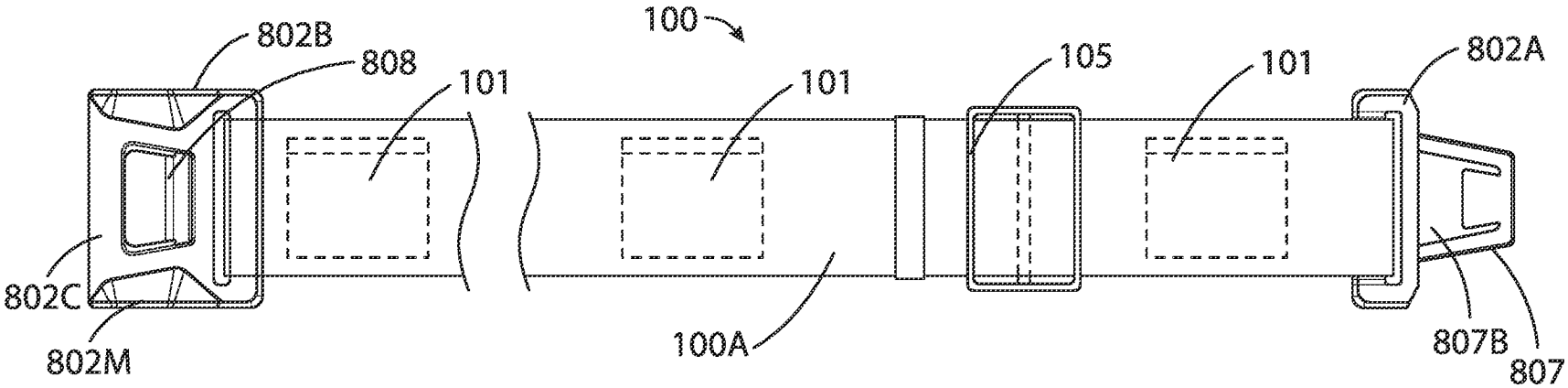
FIG. 11A is a top view of the disengaged buckle attached to the strap.
Figure 11B:
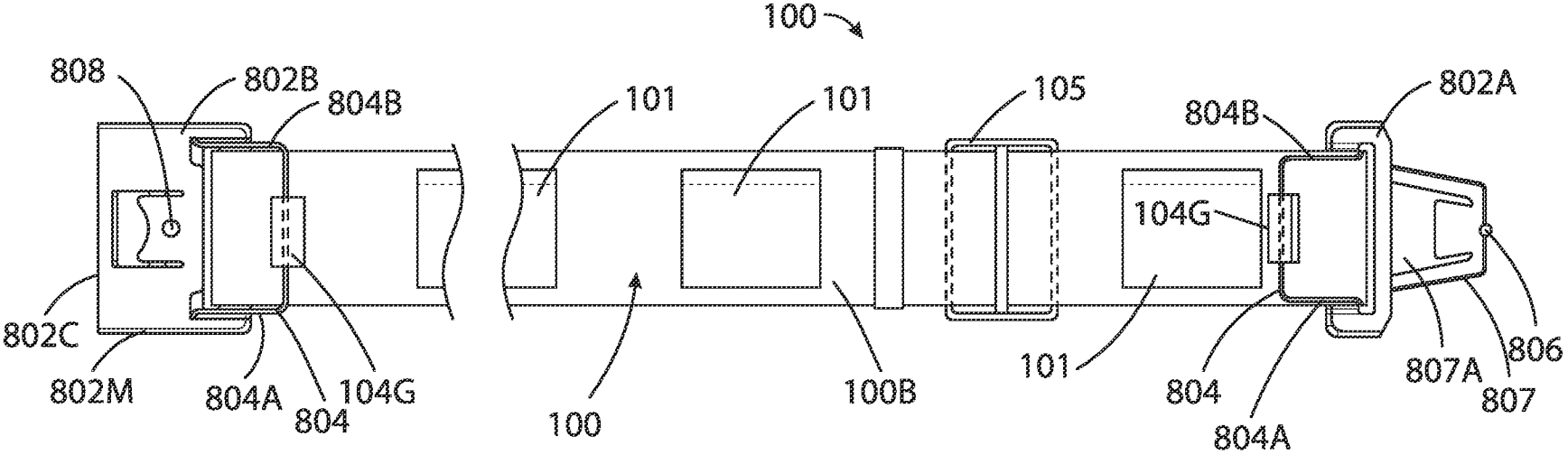
FIG. 11B is a bottom view of the disengaged buckle attached to the strap.

FIG. 11A is a top view of the disengaged buckle attached to the strap. FIG. 11B is a bottom view of the disengaged buckle attached to the strap. In this illustration, the buckle 802 is shown detached in two interlocking parts: a male end 802A and a female end 802B. The male end 802A comprises a first movable two-prong flexible arm 804 with a bottom surface 804A and a top surface 804B that is mechanically connected to a prong 807 comprising a bottom surface 807A and a top surface 807B; and a first compressible button 806 located on the prong bottom surface 807A and a second compressible button 806 located on the first movable two-prong flexible arm bottom surface 104A.

Also shown in FIG. 11, the female end 802B of the buckle 802 comprises a second movable two-prong flexible arm 804 with a bottom surface 804A and a top surface 804B that is mechanically connected to the female end 802B of the buckle 802, a horizontally bifurcated slot 802C comprising a top outer surface 802D, a bottom outer surface 802E, a top cavity 802F and a bottom cavity 802G; and a first locking buttonhole 808 located on the top outer surface 802D and a second locking button hole 808 located on the bottom outer surface 802E.

FIG. 11B also illustrates an exemplary embodiment for the first and second movable two prong flexible arms 804. When the movable rings are not in use, they may be held in place by a Velcro strap 104G located on the bottom or back surface 100B of the strap 100. In another embodiment and as commonly known the art, the Velcro strap 104G can be substituted with any similar mechanism such as but not limited to a strap with a snap or button (not shown). The arms 804 might also be held in place by a sleeve or pocket located on the bottom or back surface 100B of the strap 100 (not shown). In one embodiment, the D-ring 104C can be sewn into the bottom or back surface 100B of the strap 100 and the collapsible latch 104D can be opened to interconnect the arms 804 and hold the arms to the back surface 100B of the strap 100. Securing the arms to the bottom or back surface 100B of the strap 100 hides them from view when not in use to create a clean look on the top or front surface 100A of the strap 100.

Figure 12A:
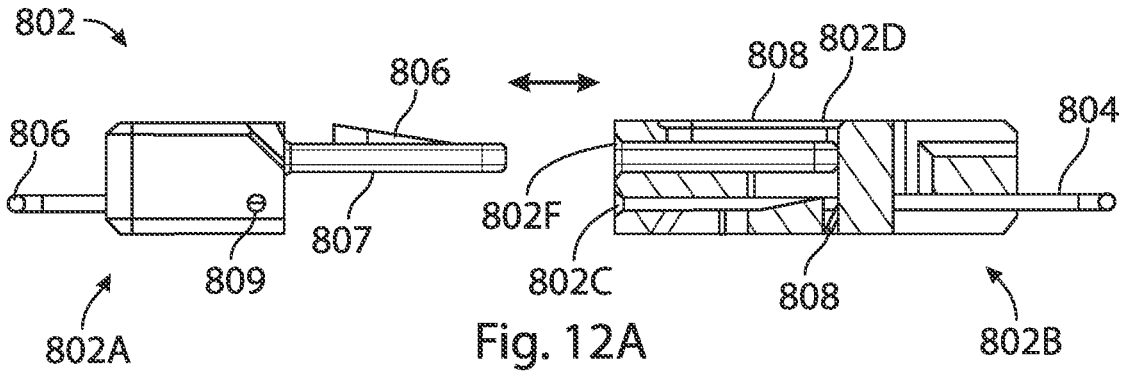
FIG. 12A is a cutaway side view of the disengaged female end and male end of the buckle with the female end flexible arm and male end flexible arm in position to attach to the strap and the male end of the buckle in a position to engage the bifurcated slot of the female end of the buckle.
Figure 12B:
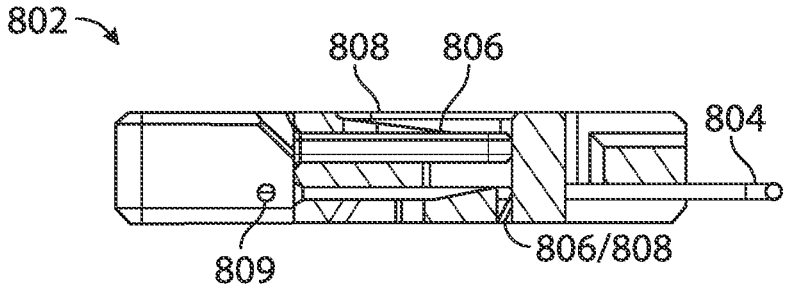
FIG. 12B is a cutaway side view of the engaged female end and male end of the buckle with the female end flexible arm in position to attach to the strap and the male end flexible arm engaged in the bifurcated slot of the female end of the buckle.
Figure 12C:
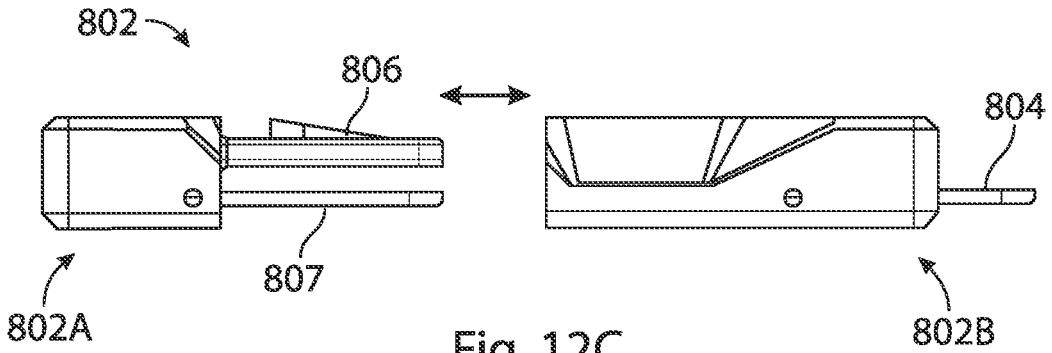
FIG. 12C is a cutaway side view of the disengaged female end and male end of the buckle with the female end flexible arm in position to attach to the strap and the male end flexible arm in a position to engage the bifurcated slot of the female end of the buckle.

FIG. 12B shows a cutaway side view closed embodiment of the cross-body strap 100 buckle 802 in which prong 807 is inserted into the top cavity 802F of the bifurcated slot 802C and the first compressible button 806 located on the prong bottom surface 807A is inserted into the first locking button hole 808 located on the top outer surface 802D of the bifurcated slot 8026. In one embodiment of the cross-body strap 100, the first movable arm 804 of the male end 802A is interlinked with the second movable arm 804 of the female end 802B mechanically connected to the horizontally bifurcated slot 102G. In this configuration, the inserted prong 807 and the interlinked first and second arms 804 provide an added measure of security in locking the strap 100 to the user's body. The buckle 802 is unlocked or released by pressing the first compressible button 806 and disconnecting the movable arms 804.

In one embodiment, the first movable arm 804 and second movable arm 804 operate as a universal interlocking ring system as illustrated in FIG. 6. More specifically, arms 804 can attach to each other or be linked to a traditional shoulder bag, fanny pack or suitcase when larger storage capacity is required. Depending on the configuration of the larger bag or suitcase, the strap 100 might also be engaged as describe in FIGS. 3-5 under a larger suitcase flap 109 such as the one shown FIG. 6. In this embodiment, a user may carry a bag onto an airplane, for example, and quickly release the larger bag for storage into an overhead compartment and then just as quickly buckle the strap 100 back to the user. This keeps all necessary personal items such as tickets, money, phone or medicine at the user's fingertips; no more rummaging through a suitcase for the items the user wants close at hand.

Figure 13:
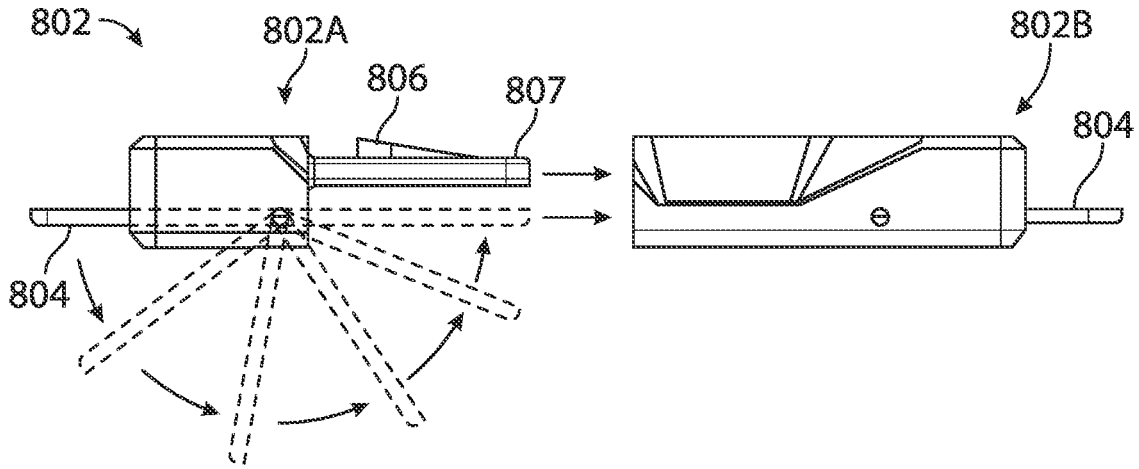
FIG. 13 is a side view of the disengaged male and female ends that illustrates the motion of the male end flexible arm as it is moved from a position attached to the strap to a position to engage the bifurcated slot of the female end of the buckle.

FIG. 13 is a side view of the disengaged male and female ends that illustrates the motion of the male end flexible arm as it is moved from a position attached to the strap to a position to engage the bifurcated slot of the female end of the buckle.

As illustrated and discussed above, the present invention combines a men's wallet with the capacity of a fanny pack, the fashion of a chest sling and the multifunctional utility of a duty belt. It is a fashionable ambidextrous adjustable cross-body pocketed strap with a buckle, buckle slide cover, a universal keyring lock system and a plurality of variably sized pockets located on both sides of the strap worn over or under clothes. It is perfect for outdoorsman but also fashionable and discreet for wearing under business attire. It is made of sturdy but sleek water resistant or waterproof material and the plurality of variably sized pockets are suitable for money, credit cards, pocketknife, cell phone, reflectors, keys, notes, ear pods, blue tooth technology, phone charger etc. In one embodiment, at least one of the plurality of variably sized pockets is expandable to hold larger item's like a water bottle or small firearm.

In one embodiment, some of the pockets may also contain various mechanical fasteners such as hooks, carabiners and small straps that may be used to connect to a dog leash, gloves, various sport gear and/or any item you want attached by rope or cord. The buckle adapted ends of the cross-body strap co-terminate with a universal keyring system that can be linked together, to the buckle or alternatively linked to a traditional shoulder bag, fanny pack or suitcase when larger storage is required. The buckle slide cover and universal lock system also provide added security as external safety mechanisms to prevent accidental release of the strap should the buckle disengage. In one aspect of the present invention, the cross-body strap for a larger bag, but it's all about the strap and not the bag for everyday use. The strap can just be released from the bag and taken anywhere. It has a plurality of variably sized inserts and pockets for cell phone, keys, notes, ear pods, blue tooth technology, phone charger etc. In one embodiment, the cross-body strap has Bluetooth technology.

The traditional material for wallets is leather or fabric, but many other flexible flat sheet materials can be used in their fabrication. Non-woven textiles such as Tyvek are used, sometimes including reuse of waterproof maps printed on that material. Woven metals, such as fine mesh made of copper or stainless steel have been incorporated into wallets that are promoted as having electromagnetic shielding properties to protect against unauthorized scanning of embedded NFC & RFID tags. Any of these same materials or combination of materials can be sued for the cross-body strap. Other fabrics used to make the cross-body strap include but are not limited to nylon, polyester, laminate, ripstop, cotton, felt, rubber, plastic, PVC, etc.

In one embodiment, the cross-body strap and its pockets are made of water-resistant material. In another embodiment the cross-body strap and its pockets is completely waterproof. Pockets can be made not only of water resistant or waterproof material but can also be sealed with zip locks and waterproof casings such as but not limited to those used for phones and cameras which are commonly known in the art. In another embodiment, the cross-body strap is made in whole, or in part of reflective material. The clasps and buckles can be substituted with button, snaps and Velcro. The buckle can be substituted with other well-known clasps, fasteners, hooks, carabiners, brooch, buckle, catch, clamp, clench, clinch, clip, clutch, embrace, fastening, fibula, grapple, grasp or grip, and Velcro.

An alternate use for the cross-body strap includes but is not limited to use as a reflector at night for bikers and joggers. In one embodiment, the cross-body strap comprises a panic alarm button. In one embodiment, the cross-body strap comprises a flotation device. In one embodiment, the cross-body strap comprises a beacon and/or a tracking system for people with special needs or elderly experiencing memory loss. In another embodiment, the cross-body strap can be designed for men, women, children and the elderly wherein the pocket design can be selected for particular needs with personalized features.

These and other advantages of the invention will be further understood and appreciated by those skilled in the art by reference to the following written specification, claims and appended drawings. In the foregoing description, it will be readily appreciated by those skilled in the art that modifications may be made to the invention without departing from the concepts disclosed herein, Such modifications are to be considered as included in the following claims, unless the claims by their language expressly state otherwise.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof, the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future.

Likewise, where this document refers to technologies that would be apparent or known to one of ordinary skill in the art, such technologies encompass those apparent or known to the skilled artisan now or at any time in the future. Furthermore, the use of plurals can also refer to the singular, including without limitation when a term refers to one or more of a particular item; likewise, the use of a singular term can also include the plural, unless the context dictates otherwise.

While various embodiments of the present disclosure, have been described above, it should be understood that they have been presented by way of example only, and not of limitation. Likewise, the various diagrams may depict an example architectural or other configuration for the invention, which is provided to aid in understanding the features and functionality that can be included in the invention. The invention is not restricted to the illustrated example architectures or configurations, but the desired features can be implemented using a variety of alternative architectures and configurations.

Indeed, it will be apparent to one of skill in the art how alternative functional configurations can be implemented to implement the desired features of the present disclosure. Additionally, with regard to operational descriptions and method claims, the order in which the steps are presented herein shall not mandate that various embodiments be implemented to perform the recited functionality in the same order unless the context dictates otherwise.

Although the disclosure is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the disclosure, whether or not, such embodiments are described and whether or not such features are presented as being a part of a described embodiment. Thus, the breadth and scope of the present invention should not be limited by any of the above-described exemplary embodiments.

What is claimed is:

1. A cross-body adjustable strap comprising:

a length adjustable strap terminating in a buckle comprising a male end and female end, said strap comprising a front surface and a back surface;

a plurality of variably sized pockets attached to the strap front surface and back surface;

a strap length adjuster movably attached to the strap; and a universal interlocking flexible arm system comprising a first movable and detachable two prong arm attached to the male end of the buckle and a second movable and detachable two prong arm attached to the female end of the buckle.

2. The cross-body adjustable strap of claim 1, wherein the male end of the buckle further comprises a prong comprising a bottom surface and a top surface; and a first compressible button located on the prong bottom surface; the first movable arm comprises a bottom surface and a top surface and a second compressible button located on the ring bottom surface; the female end of the buckle further comprises a horizontally bifurcated slot comprising a top outer surface, a bottom outer surface, a top cavity configured to receive the prong and a bottom cavity configured to receive the first movable arm, a first locking button hole located on the top outer surface; and a second locking button hole located on the bottom outer surface.

3. The cross-body adjustable strap of claim 1, further comprising a slidable buckle cover movably attached to the strap, wherein slidable buckle cover is made of incompressible material.

4. The cross-body adjustable strap of claim 1, wherein the strap is water resistant.

5. The cross-body adjustable strap of claim 1, wherein the strap is waterproof.

6. The cross-body adjustable strap of claim 1, wherein the first and second movable arms are D-rings with a collapsible latch.

7. The cross-body adjustable strap of claim 1, wherein the first and second movable arms are circular rings with a collapsible latch.

8. The cross-body adjustable strap of claim 1, wherein the first and second movable arms are keyrings.

9. The cross-body adjustable strap of claim 1, further comprising a hook and loop strap located on the bottom or back surface of the strap.

10. The cross-body adjustable strap of claim 1, further comprising a D-ring with a collapsible latch sewn into the bottom or back surface of the strap.

11. The cross-body adjustable strap of claim 1, wherein at least one of the plurality of variably sized pocket is expandable.

12. The cross-body adjustable strap of claim 1, wherein the dimensions of the strap are from 48 to 86 inches in length and 1.5 to 5 inches in width.

13. The cross-body adjustable strap of claim 1, wherein the dimensions of the strap are 66 inches in length and 2.5 inches in width.

* * * * *